US006733146B1

(12) United States Patent
Vastano

(10) Patent No.: US 6,733,146 B1
(45) Date of Patent: May 11, 2004

(54) ILLUMINATED KNOB FOR INDICATING THE OPERATIVE CONDITION OF AN APPLIANCE

(76) Inventor: Pat J. Vastano, 154 Davis Ave., Piscataway, NJ (US) 08854

( * ) Notice: Subject to any disclaimer, the term of this patent is extended or adjusted under 35 U.S.C. 154(b) by 0 days.

(21) Appl. No.: 10/339,625

(22) Filed: Jan. 10, 2003

(51) Int. Cl.[7] ..... F21V 33/00

(52) U.S. Cl. ..... 362/23; 362/29; 362/253; 362/276

(58) Field of Search ..... 362/23, 29, 276, 362/802, 253

(56) References Cited

U.S. PATENT DOCUMENTS

| | | | | |
|---|---|---|---|---|
| 3,864,561 A | | 2/1975 | Spira et al. | |
| 4,255,669 A | | 3/1981 | Naugle | |
| 4,446,455 A | | 5/1984 | Nashawaty | |
| 5,093,764 A | | 3/1992 | Hasegawa et al. | |
| 5,335,148 A | | 8/1994 | Tominaga | |
| 5,467,077 A | | 11/1995 | Wunderlich et al. | |
| 5,608,378 A | | 3/1997 | McLean et al. | |
| 5,631,454 A | * | 5/1997 | Hubacher et al. | 200/50.01 |
| 5,669,147 A | | 9/1997 | Nakajima et al. | |
| 5,900,678 A | * | 5/1999 | Rodgers | 307/10.1 |
| 5,901,836 A | | 5/1999 | Taniuchi | |
| 5,939,992 A | | 8/1999 | Devries et al. | |
| 6,019,480 A | * | 2/2000 | Polkow | 362/96 |
| 6,115,929 A | | 9/2000 | Tanazawa et al. | |
| 6,176,589 B1 | * | 1/2001 | Ishiguro | 362/27 |
| 6,341,428 B1 | | 1/2002 | Tanazawa et al. | |
| 6,396,012 B1 | | 5/2002 | Bloomfield | |
| 2002/0075668 A1 | | 6/2002 | Dorrie | |

* cited by examiner

*Primary Examiner*—Thomas M. Sember
(74) *Attorney, Agent, or Firm*—Richard C. Litman

(57) ABSTRACT

An illuminated knob for indicating the operative condition of an appliance having a light operatively coupled to the knob, an attitude sensing electrical switch, and a compartment for a replaceable voltage source. Operating independently of the appliance energy source, the light illuminates when the knob is rotated to a position corresponding to an "on" condition of the appliance, signaling the operative status of the appliance to the user. The light goes off when the knob is turned to the "off" position, indicating the safe and inoperative condition of the appliance. The knob requires no activation other than installation of the front surface mounted battery and all parts are sealed within the knob housing for reliability and safety.

8 Claims, 6 Drawing Sheets

ILLUMINATED KNOB FOR INDICATING THE OPERATIVE CONDITION OF AN APPLIANCE

BACKGROUND OF THE INVENTION

1. Field of the Invention

The present invention relates to home appliances and more specifically, to a lighted appliance knob for indicating the operative condition of an appliance. The lighted knob may be installed on any appliance which has a knob for turning on the appliance, whether the appliance operates on electricity, or whether the appliance has a mechanical valve, such as a gas powered appliance.

2. Description of the Related Art

Lighted knobs and methods for sensing and indicating the operative condition of an appliance are well represented in the prior art. Sensing the "on" state of an appliance is a highly desired feature in an appliance, especially in one powered by electricity or gas.

The sensing of the operative state of an appliance and the signaling of that active state to a user are known to those skilled in the art. U.S. Pat. No. 5,939,992, issued to Devries et al., U.S. Pat. No. 4,255,669, issued to Naugle, U.S. Pat. No. 4,446,455, issued to Nashawaty, U.S. Pat. No. 5,467,077, issued to Wunderlich et al. and U.S. Pat. No. 5,608,378, issued to McLean et al., are but a few of the patents disclosing sensor circuits signaling to an external indicating device the operative state of an electrical appliance. The aforementioned devices all suffer from the requirement of relatively complex electronic circuitry mounted on a circuit board located within the appliance, and depend upon the power source of the appliance to energize the sensing circuitry.

Lighted appliance knobs have served both for illumination in low light situations and for indicating the operative condition of the appliance. U.S. Pat. No. 3,864,561, issued to Spira et al. in 1975, relates to a lamp in a dimmer switch powered by voltage source that is itself controlled by the switch. U.S. Pat. No. 5,093,764, issued to Hasegawa et al. in 1992, discloses a coaxial switch illuminated by a light source on the back of the panel surface on which the switch is mounted for indicating the "on" position of an air conditioning or similar system. U.S. Pat. No. 5,335,148, issued to Tominaga, includes an illuminated knob, the rotary shaft of a variable resistor, a switch and a light-emitting diode. Taniuchi discloses in U.S. Pat. No. 5,901,836 a lighted knob switch combination which receives power from the appliance and consists of springs and contacts which close when the knob is rotated thus providing current to a small lamp or light emitting diode. U.S. patent application Ser. No. 2002/0075668 proposes to illuminate the adjusting knob by means of a light guide and light-emitting diodes on a printed-circuit board mounted to a dividing wall between the knob and the appliance. These devices suffer from a complexity of design, require the appliance to provide the power to light the lamp, or have the lamp in the panel surface behind the knob as opposed to being integrated within the knob.

None of the above inventions and patents, taken either singly or in combination, is seen to describe a self-contained lighted knob which serves to indicate the operative state of an appliance as claimed in the instant invention. Thus a lighted appliance knob solving the aforementioned problems is desired.

SUMMARY OF THE INVENTION

The present invention is a safety device in the form of a lighted knob adapted for indicating the operative condition of an appliance. Oftentimes, people, especially the elderly and children of all ages, forget to turn off appliances after use. This has been the cause of many electrical fires and gas explosions. To aid in visually identifying when an appliance is active, the present invention includes a lighted knob and self-contained circuitry which operates independent of the energy source supplying the appliance. The lighted knob has a light source mounted on the outer surface of the knob, a tilt or attitude sensing electrical switch, and a battery compartment. The knob is so designed that when it is mounted vertically on an appliance, any axial rotation of the knob away from the "off" position will complete an electric circuit illuminating the light, signaling the operating state of the appliance to the user. The light goes off when the knob is turned to the "off" position, indicating the safe and inoperative condition of the appliance. The knob requires no activation other than installation of a battery. All integral parts are sealed within the knob housing for reliability and safety. The lighted knob can be constructed to replace virtually any style appliance knob, or may be offered as part of original manufactured equipment.

Accordingly, it is a principal object of the invention to provide a safety device for indicating the "on" condition of an appliance.

It is another object of the invention to provide a method of using a lighted appliance knob for indicating the active condition of an appliance.

It is a further object of the invention to provide a lighted appliance knob with all required components contained within the knob and which is powered independent of the source of power of the appliance.

Still another object of the invention is to provide a lighted appliance knob which may be installed either as original equipment at the time of manufacture or as an aftermarket modification.

It is an object of the invention to provide improved elements and arrangements thereof for the purposes described which is inexpensive, dependable, environmentally safe and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
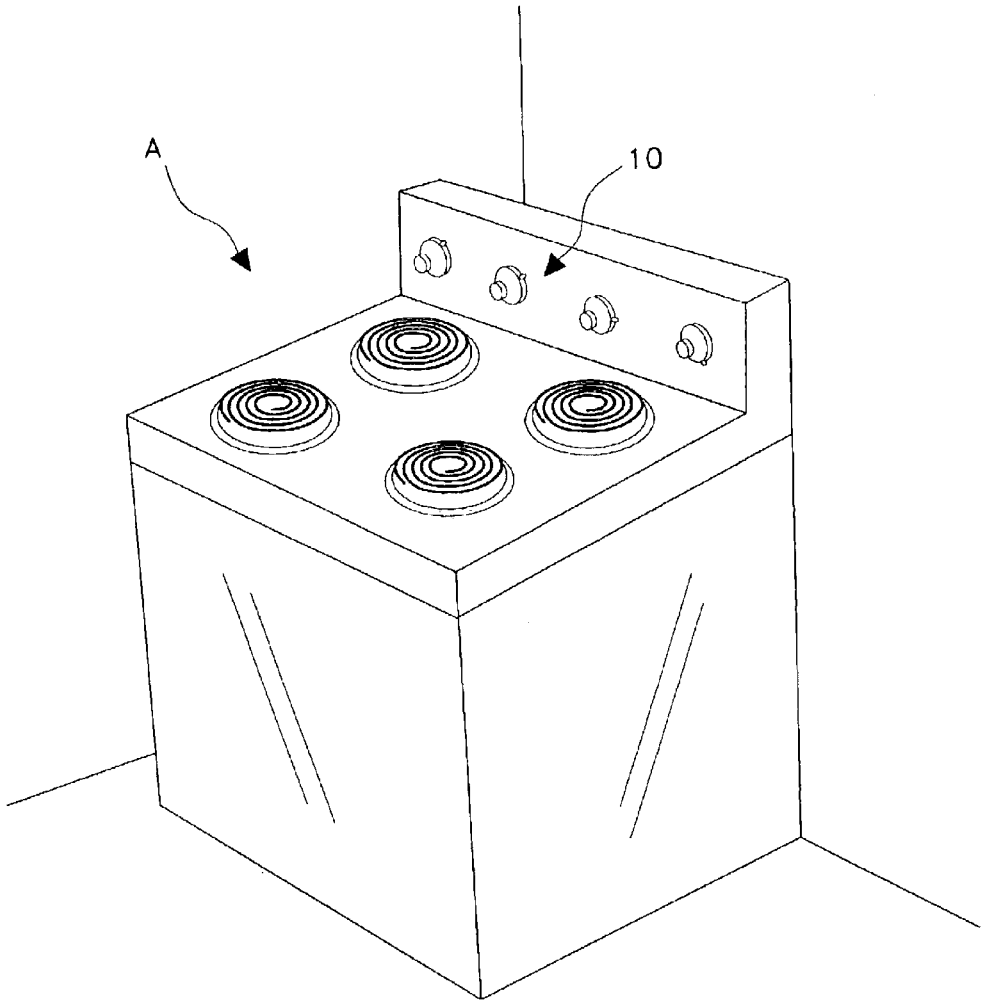
FIG. 1 is an environmental, perspective view of a kitchen range having at least one lighted appliance knobs according to the present invention.

FIG. 1 illustrates at least one lighted appliance knob 10 according to the present invention mounted on and operatively connected to an electric range A. The knob 10 illuminates when the axial position of the knob 10 is in any position other than the "off" position. Although the appliance as shown in FIG. 1 is an electric range A, the present invention operates independent of the energy source of the appliance.

Figure 2:
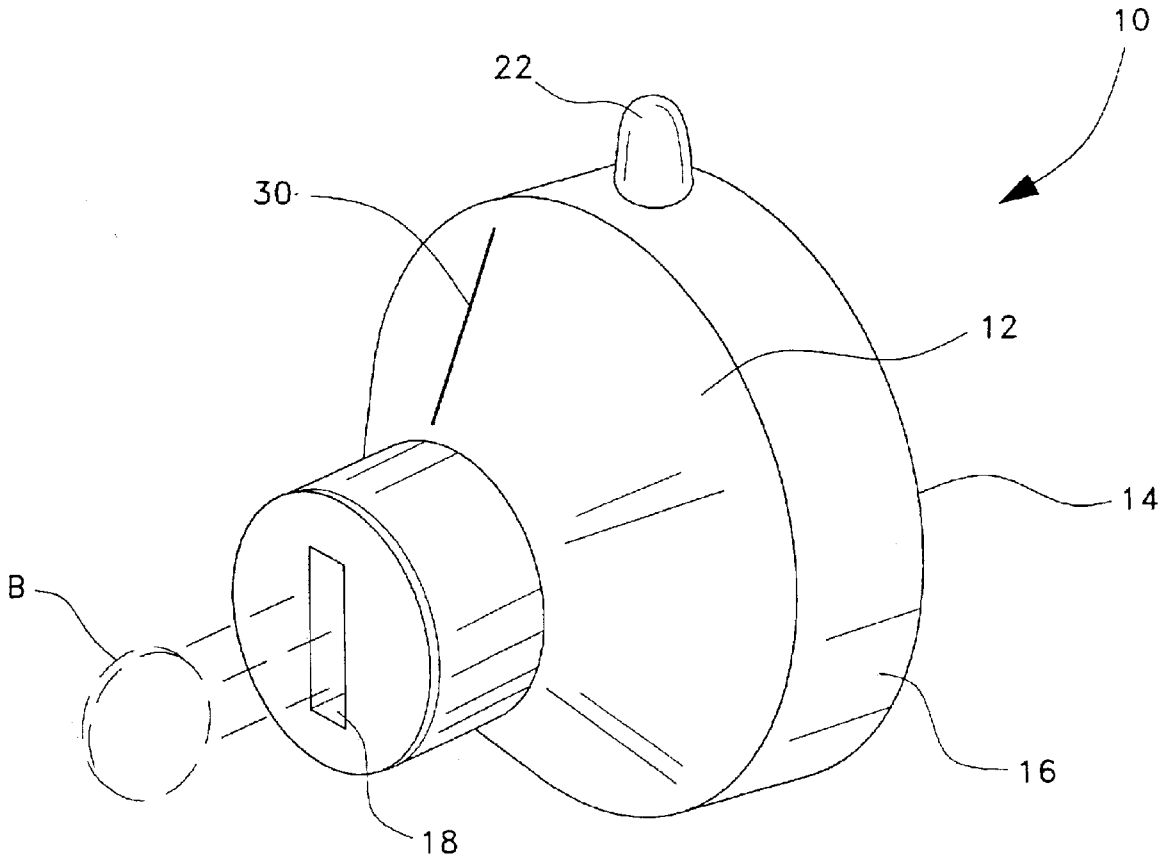
FIG. 2 is a perspective drawing of the lighted appliance knob according to the present invention.
Figure 3:
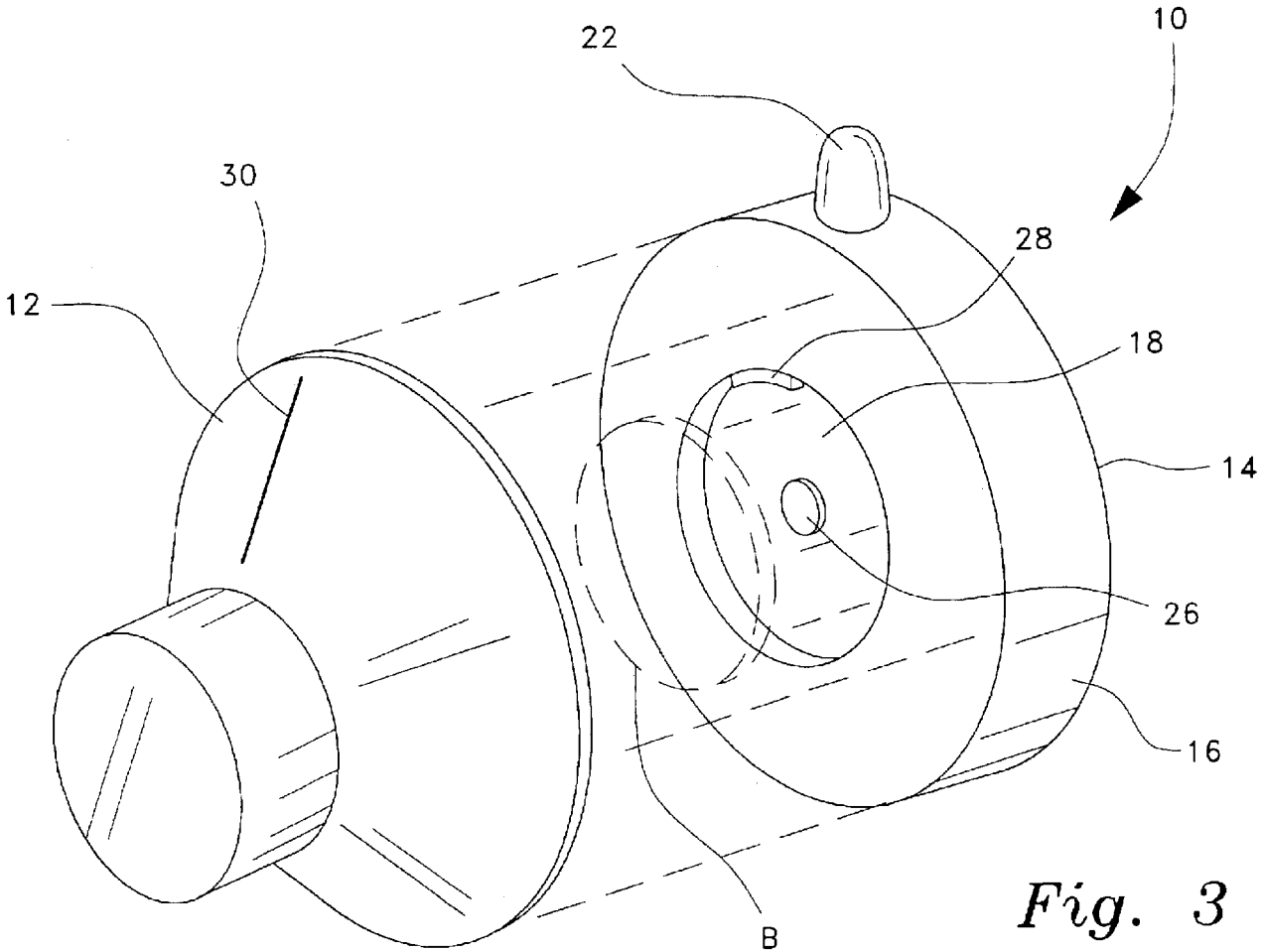
FIG. 3 is an exploded view of an alternate embodiment of the lighted appliance knob according to the present invention.
Figure 5:
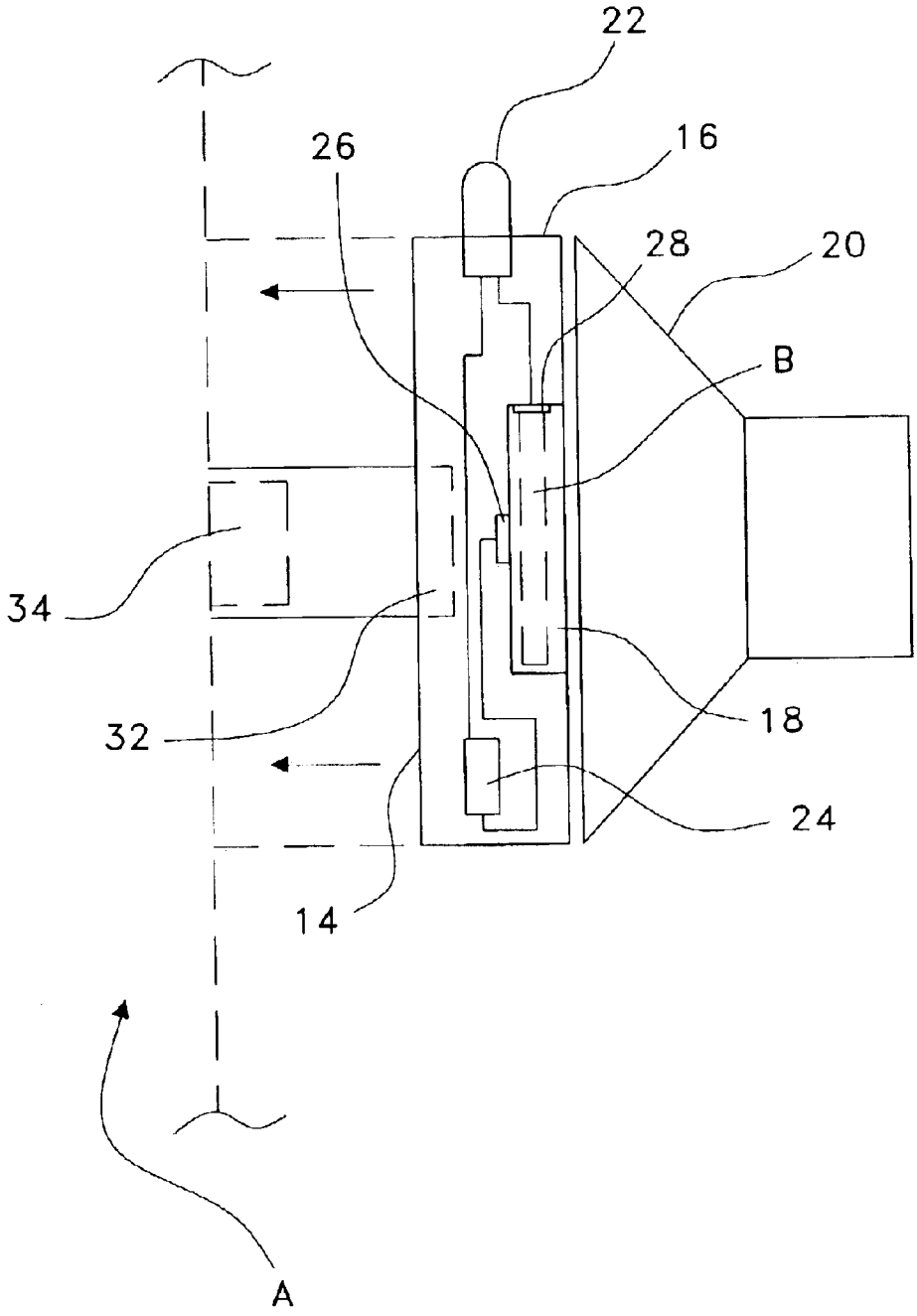
FIG. 5 is a side view of the lighted appliance knob according to the present invention.

FIG. 2 illustrates the knob 10 in the unlit or non-operative position. The knob 10, constructed from a hard plastic material, has front and rear surfaces, 12 and 14 respectively, an outer edge 16, and a battery compartment 18 accessible from the front surface 12. FIGS. 3 and 5 illustrate another embodiment of the knob with the battery compartment 18 hidden beneath a snap-on front surface 12. A recess 32 in the rear surface of the knob frictionally receives the control spindle 34 of the appliance. The non-operative axial position of the knob 10 is defined by a light 22 extending through the outer edge 16 of the knob 10. In the present embodiment the light 22 preferably is a red 2–3 volt light-emitting diode (LED) fastened in place with glue or equivalent material. Alternative light sources include incandescent, neon, or equivalent light sources. Graduation markings 30 are provided on the front surface 12 for further identification of the operative condition of the appliance.

Figure 4A:
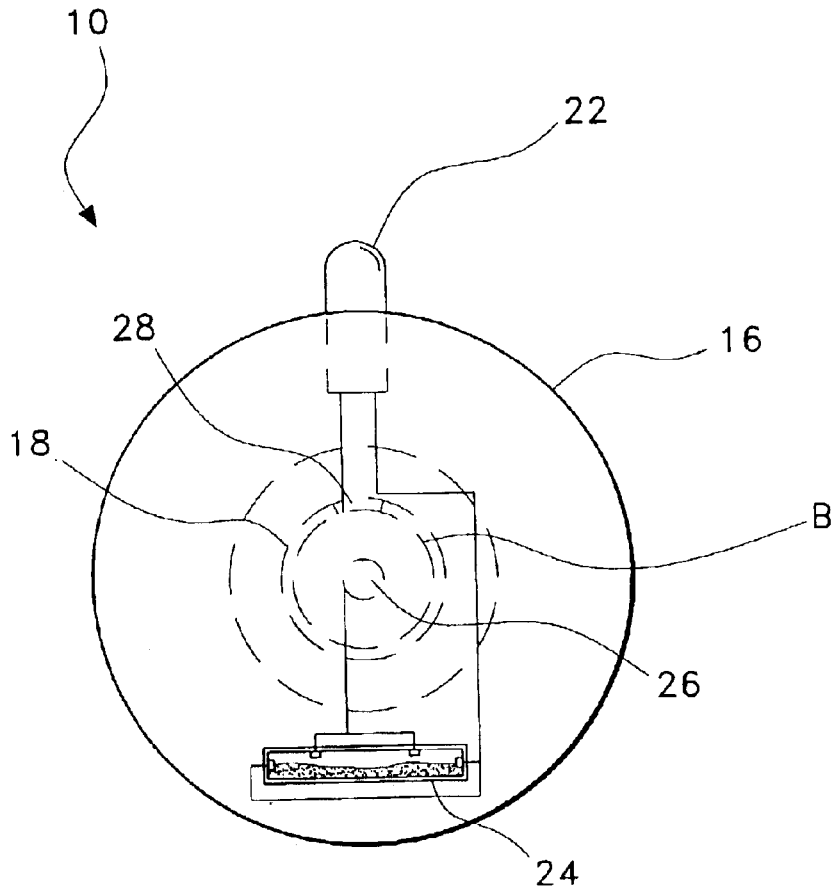
FIGS. 4A and 4B are rear views of the lighted appliance knob according to the present invention in the non-illuminated and illuminated positions, respectively.
Figure 4B:
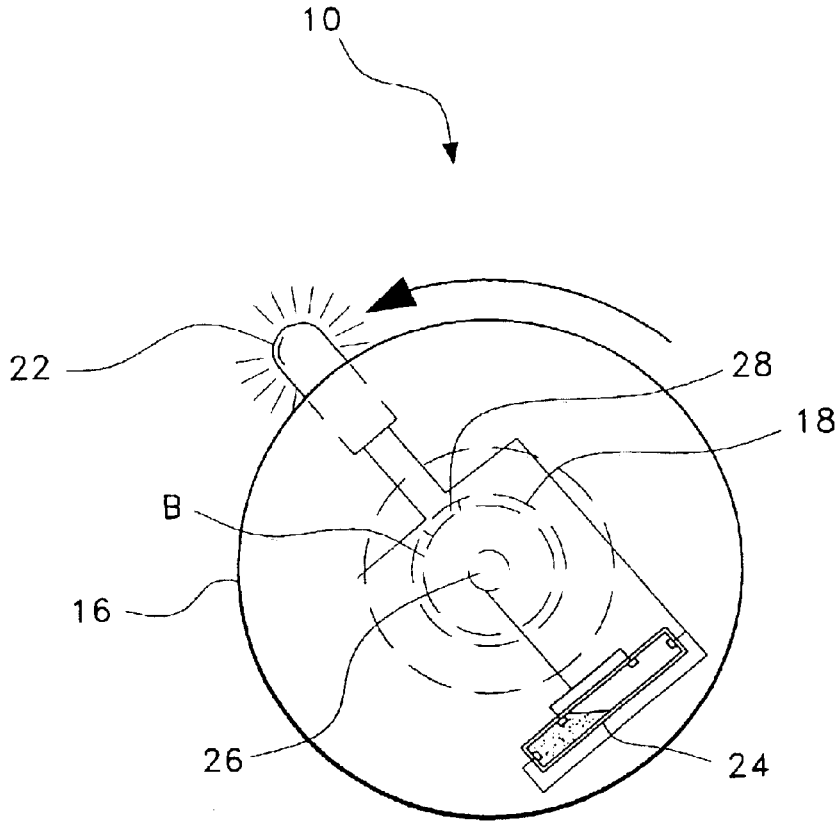

As shown in FIGS. 4A and 4B, the electric circuit providing voltage to the light 22 is powered by a three volt lithium battery B. The circuit includes an attitude sensing electric switch 24 mounted within the knob 10. The attitude sensing electrical switch 24 senses the axial rotation of the knob and provides an electrical connection between the battery B and the light 22 when the knob 10 is in an axial position corresponding to the operating condition of the appliance. Mercury switches for providing electrical continuity contingent upon the relative position of the switch are well known to those skilled in the art. However, because of environmental considerations regarding the toxic characteristics of mercury, alternative switch implementations may be desirable, such as those disclosed by Nakajima et al. in U.S. Pat. No. 5,669,147, which discloses a conducting ball and electrodes in a non-conducting case, U.S. Pat. No. 6,396,012 issued to Bloomfield, which discloses an attitude sensing electric switch using electrically conducting powder as a switching medium, and U.S. Pat. Nos. 6,116,929 and 6,341,428, issued to Tanazwara et al., which disclose a tilt activated switch comprising a ball rolling on a pair of electrodes within a non-conducting enclosure. Accordingly U.S. Pat. Nos. 5,669,147, 6,396,012, 6,116,929 and 6,341,428, are incorporated by reference in their entirety.

An appliance, so equipped with a lighted knob 10 according to the present invention, provides a bright visual indication when the knob 10 is rotated to a position corresponding to an operative condition of the appliance. Since the device is battery powered and is physically compact, integrated unit, it may be used with gas stoves and other appliances which are operated by turning as mechanical valve, as well as electrical appliances that have a rotating knob operating an electrical switch. It is to be understood that the present invention is not limited to the embodiments described above, but encompasses any and all embodiments within the scope of the following claims.

What is claimed is:

1. A lighted appliance knob, comprising:

(a) a knob mountable to a control spindle horizontally mounted to a vertical surface of an appliance, the knob having a front surface, a rear surface, and an edge extending between the front surface and the rear surface;

(b) a light mounted in the knob;

(c) an electrical power source disposed within the knob;

(d) an attitude sensing electrical switch disposed within the knob, the switch electrically connected between the light and the power source;

wherein the knob has an off position in which the attitude sensing switch electrically disconnects the power source from the light, and an on position when the knob is rotated in which the attitude sensing switch electrically connects the power source to the light in order to visually indicate when the appliance has been turned on.

2. The lighted appliance knob according to claim 1, further comprising a battery compartment disposed in the knob and accessible from the front surface.

3. The lighted appliance knob according to claim 1, wherein the light is a light-emitting diode.

4. The lighted appliance knob according to claim 1, wherein the light is an incandescent light.

5. The lighted appliance knob according to claim 1, wherein the light is a neon light.

6. The lighted appliance knob according to claim 1, wherein the power source is a battery removably received by the knob.

7. The lighted appliance knob according to claim 1, wherein the power source is a lithium battery.

8. The lighted appliance knob according to claim 1, wherein said attitude sensing electrical switch comprises a mercury switch.

* * * * *